US008942613B2

(12) United States Patent
Ohtsu

(10) Patent No.: US 8,942,613 B2
(45) Date of Patent: Jan. 27, 2015

(54) SLIDING MEMBER FOR FIXING DEVICE, FIXING DEVICE, AND IMAGE FORMING APPARATUS

(75) Inventor: Shigemi Ohtsu, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 141 days.

(21) Appl. No.: 13/566,634

(22) Filed: Aug. 3, 2012

(65) Prior Publication Data

US 2013/0216282 A1 Aug. 22, 2013

(30) Foreign Application Priority Data

Feb. 21, 2012 (JP) ..... 2012-034954

(51) Int. Cl.
*G03G 15/20* (2006.01)

(52) U.S. Cl.
CPC .... *G03G 15/2053* (2013.01); *G03G 2215/2009* (2013.01); *G03G 15/206* (2013.01)
USPC ..... 399/333; 399/329

(58) Field of Classification Search
CPC ..... G03G 15/2053; G03G 15/206; G03G 15/2017; G03G 15/2025; G03G 15/2075; G03G 15/2089; G03G 2215/2009
USPC ..... 399/329, 333
See application file for complete search history.

(56) References Cited

U.S. PATENT DOCUMENTS

| | | | | |
|---|---|---|---|---|
| 6,456,819 | B1 | 9/2002 | Abe et al. | |
| 8,064,798 | B2 * | 11/2011 | Shinshi et al. | 399/122 |
| 8,195,072 | B2 | 6/2012 | Okuno | |
| 2003/0035667 | A1 * | 2/2003 | Izawa et al. | 399/333 |
| 2009/0014942 | A1 | 1/2009 | Okuno | |
| 2011/0222931 | A1 * | 9/2011 | Shinshi et al. | 399/329 |
| 2011/0286775 | A1 * | 11/2011 | Ishihara et al. | 399/329 |
| 2013/0034374 | A1 * | 2/2013 | Ohtsu et al. | 399/329 |
| 2013/0189007 | A1 * | 7/2013 | Ohtsu | 399/329 |

FOREIGN PATENT DOCUMENTS

| | | | |
|---|---|---|---|
| JP | 2001-42670 | A | 2/2001 |
| JP | 2002-025759 | A | 1/2002 |
| JP | 2002-093565 | A | 3/2002 |
| JP | 2002-299007 | A | 10/2002 |
| JP | 2005-003969 | A | 1/2005 |
| JP | 3634679 | B2 | 3/2005 |
| JP | 2009-15227 | A | 1/2009 |
| JP | 2009-015227 | A | 1/2009 |
| JP | 2010-282237 | A | 12/2010 |

OTHER PUBLICATIONS

Japanese Office Action issued Jan. 8, 2013 in corresponding Japanese Patent Application No. 2012-034954.

* cited by examiner

*Primary Examiner* — Benjamin Schmitt
(74) *Attorney, Agent, or Firm* — Sughrue Mion, PLLC

(57) ABSTRACT

A sliding member for a fixing device includes at least a fluororesin layer that has a sliding surface, the sliding surface having a plurality of recesses that are dotted over the sliding surface, the sliding member satisfying conditions (1) and (2) below: (1) the dotted recesses exhibit an array pattern including a grid array, the grid array having a plurality of basic arrays that are contiguous, the basic arrays each including a basic grid and a central point of the basic grid, the basic grid being defined by four grid points and having one side parallel to a sliding direction, at least one of the central points of the basic arrays in the grid array being displaced from the grid array; and (2) at least one of the recesses is placed over an entire width of the sliding surface, when the sliding surface is viewed along the sliding direction.

16 Claims, 6 Drawing Sheets

SLIDING MEMBER FOR FIXING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2012-034954 filed Feb. 21, 2012.

BACKGROUND (i) Technical Field

The present invention relates to a sliding member for a fixing device, a fixing device, and an image forming apparatus.

(ii) Related Art

Image forming apparatuses employing an electrophotographic system, such as copiers and printers, form an image by fixing an unfixed toner image formed on recording paper onto the recording paper by a fixing device.

As an example of this fixing device, a fixing device employing a so-called belt nip system exists. This fixing device is either configured to include a heat roller and a pressure belt placed in contact with the heat roller, or configured to include a heat belt and a pressure roller placed in contact with the heat belt.

In such a fixing device, the belt is pressed against the corresponding roller from its inner surface by a pressing member, and a sliding member is provided between the belt and the pressing member for the purpose of reducing sliding resistance caused by rotation of the belt.

SUMMARY

According to an aspect of the invention, there is provided a sliding member for a fixing device, including at least a fluororesin layer that has a sliding surface, the sliding surface having a plurality of recesses that are dotted over the sliding surface, the sliding member satisfying conditions (1) and (2) below: (1) the dotted recesses exhibit an array pattern including a grid array, the grid array having a plurality of basic arrays that are contiguous, the basic arrays each including a basic grid and a central point of the basic grid, the basic grid being defined by four grid points and having one side parallel to a sliding direction, at least one of the central points of the basic arrays in the grid array being displaced from the grid array; and (2) at least one of the recesses is placed over an entire width of the sliding surface, when the sliding surface is viewed along the sliding direction.

BRIEF DESCRIPTION OF THE DRAWINGS

Exemplary embodiment of the present invention will be described in detail based on the following figures, wherein.

DETAILED DESCRIPTION

Hereinafter, a sliding member for a fixing device, a fixing device, and an image forming apparatus according to an exemplary embodiment are described in detail with reference to the attached figures.

Sliding Member for Fixing Device

Figure 1:
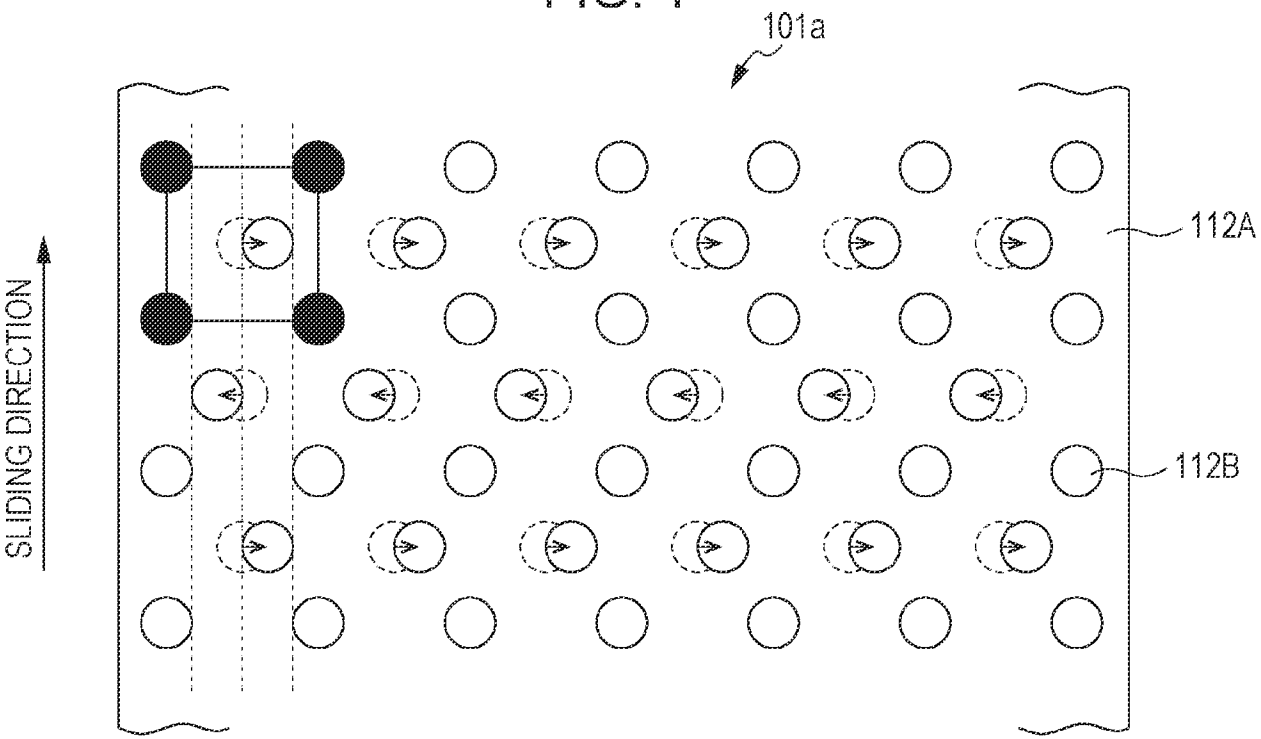
FIG. 1 is a schematic plan view illustrating an example of the array pattern of recesses in a sliding member for a fixing device according to the exemplary embodiment.
Figure 2:
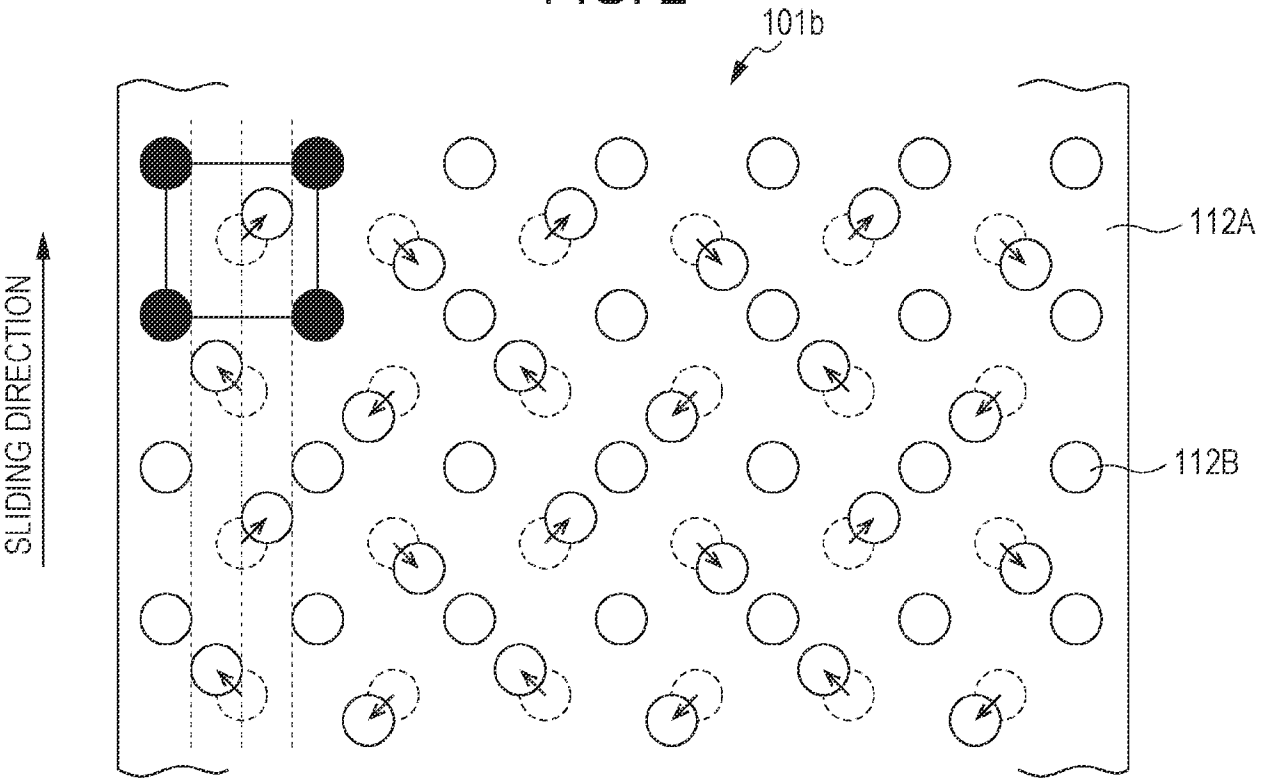
FIG. 2 is a schematic plan view illustrating another example of the array pattern of recesses in the sliding member for a fixing device according to the exemplary embodiment.

FIGS. 1 and 2 are each a schematic plan view of an example of the array pattern of recesses in a sliding member for a fixing device according to the exemplary embodiment, illustrating a sliding surface in plan view.

Figure 3A:
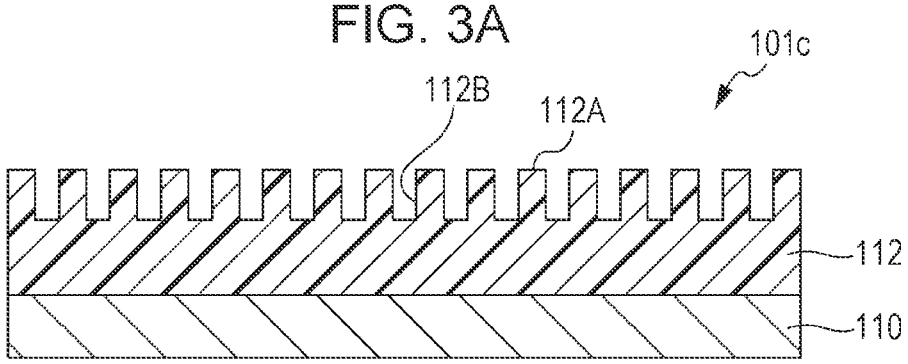
FIGS. 3A to 3C are schematic cross-sectional views each illustrating an example of the layer structure of the sliding member for a fixing device according to the exemplary embodiment.
Figure 3B:
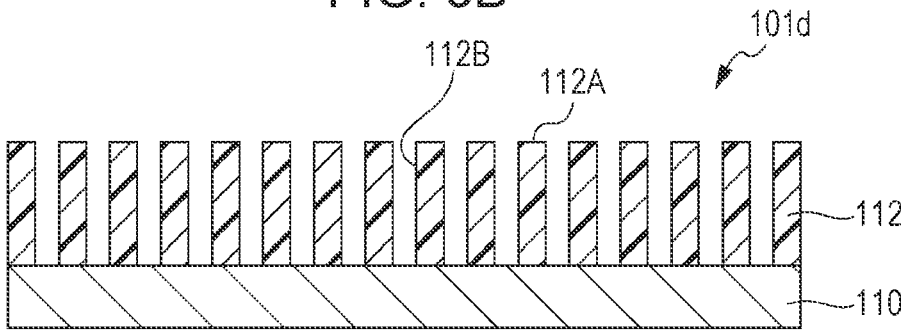
Figure 3C:
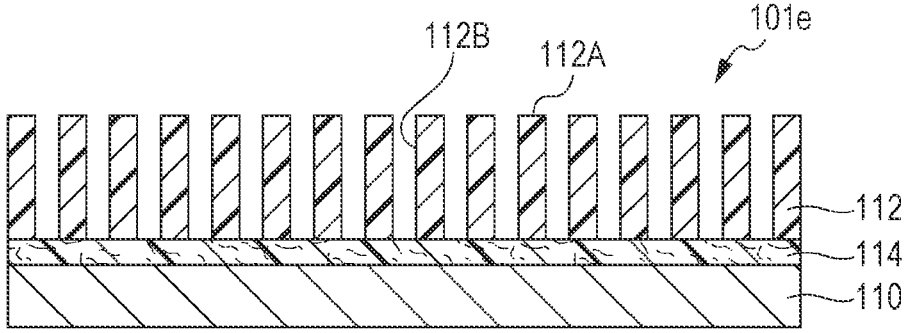

Also, FIGS. 3A to 3C are schematic cross-sectional views each illustrating an example of the layer structure of the sliding member for a fixing device according to the exemplary embodiment.

Hereinafter, the "sliding member for a fixing device" is sometimes simply referred to as "sliding member".

Recesses in the sliding surface of the sliding member

As illustrated in FIGS. 1 and 2, sliding members 101*a* and 101*b* according to the exemplary embodiment each have a sliding surface 112A dotted with multiple recesses 112B.

The array pattern of the dotted recesses 112B is required to satisfy the following conditions (1) and (2).

(1) The array pattern includes a grid array, the grid array having multiple basic arrays that are contiguous, the basic arrays each including a basic grid and a central point of the basic grid, the basic grid being defined by four grid points and having one side parallel to the sliding direction, some or all of the central points in the grid array being displaced from the grid array.

(2) At least one recess 112B is placed over the entire width of the sliding surface, when the sliding surface is viewed along the sliding direction.

When the sliding member satisfies the above conditions (1) and (2), in-plane uniformity of oil retention/supply by the recesses may be accomplished without increasing the area occupied by the recesses in the sliding surface. As a result, the sliding member according to the exemplary embodiment may keep friction coefficient from increasing even after prolonged, continued use.

In the related art, there exist sliding members with recesses that exhibit a staggered grid array pattern.

In order to reduce the coefficient of friction with a member to be slid, in these sliding members, the recesses are formed so as to occupy a large area in the sliding surface.

However, when the recesses are formed so as to occupy a large area in the sliding surface, the area of the flat portion becomes smaller, which may lead to a decrease in wear resistance and hence a shorter life. Also, simply making each individual recess larger to increase the area occupied by the recesses in the sliding surface may sometimes lead to an imbalance in the retention/supply of oil within the sliding surface and hence an increase in friction coefficient.

As mentioned above, the sliding member according to the exemplary embodiment may keep friction coefficient from increasing even after prolonged, continued use. This effect is considered to result from the following factors.

That is, the fact that the condition (2) mentioned above is satisfied means that when the sliding surface is viewed along the sliding direction, there is no area along the entire width of the sliding surface where no recess exists, and that at least one recess exists on every straight line that defines the width of the sliding surface. Such placement of the recesses ensures that when the member to be slid and the sliding member according to the exemplary embodiment slide with respect to one another, there is no area in the target surface of the member to be slid where the member to be slid does not contact the recesses. As a result, an imbalance in the retention/supply of oil by the recesses in the sliding surface may be eliminated, thereby keeping the coefficient of friction between the member to be slid and the sliding member from increasing.

Also, provided that the same number of recesses with the same diameter are to be formed, rather than arraying the recesses in a staggered grid pattern, arraying the recesses in the pattern as mentioned in (1) above may make it possible to satisfy the condition (2) without increasing the area occupied by the recesses in the sliding surface. Therefore, the sliding member according to the exemplary embodiment exhibits good wear resistance and may withstand prolonged use.

The sliding member according to the exemplary embodiment is considered to be able to keep friction coefficient from increasing with continued use over a long period of time as a result.

In some cases, the sliding member has an end portion that does not contact the member to be slid. In such cases, the end portion that does not contact the member to be slid does not correspond to the "sliding surface", and may not be provided with recesses.

The array pattern of recesses is described in detail.

The sliding member 101*a* illustrated in FIG. 1 is described.

FIG. 1 illustrates a basic grid, and a grid array that includes multiple contiguous basic arrays each formed by the basic grid and a central point (indicated by a dotted line) of the basic grid. The basic grid is indicated by four black points and has one side parallel to the sliding direction. The sliding member 101*a* has an array pattern in which the central points (indicated by dotted lines) that configure the grid array are displaced in a direction (indicated by an arrow) orthogonal to the sliding direction. According to this array pattern, by displacing the central points (indicated by dotted lines) arranged parallel to the sliding direction alternately to the left and right, it follows that at least one recess is placed on a line defined between dotted lines. As a result, the above-mentioned condition (2), i.e., at least one recess 112B be placed over the entire width of the sliding surface when the sliding surface is viewed along the sliding direction, is satisfied.

The sliding member 101*b* illustrated in FIG. 2 is described.

FIG. 2 also illustrates a basic grid, and a grid array that includes multiple contiguous basic arrays each formed by the basic grid and a central point (indicated by a dotted line) of the basic grid. The basic grid is indicated by four black points and has one side parallel to the sliding direction. The sliding member 101*b* has an array pattern in which the central points (indicated by dotted lines) that configure the grid array are displaced diagonally (indicated by an arrow) with respect to the sliding direction.

According to this array pattern, by displacing the central points (indicated by dotted lines) arranged parallel to the sliding direction diagonally to the upper right and diagonally to the lower right alternately, it follows that at least one recess is placed on a line defined between dotted lines. As a result, the above-mentioned condition (2), i.e., at least one recess 112B be placed over the entire width of the sliding surface when the sliding surface is viewed along the sliding direction, is satisfied.

The direction in which to displace the central points (indicated by dotted lines) arranged parallel to the sliding direction in the sliding member 101*a*, 101*b* is not limited to the direction illustrated in FIG. 1, 2. This direction is not particularly limited as long as at least one recess is placed on a line defined between dotted lines. In other words, the central points (indicated by dotted lines) arranged parallel to the sliding direction may be displaced either in a regular manner as illustrated in FIG. 1, 2, or in an irregular manner. In this regard, the recesses may be displaced in a regular manner from the viewpoints of balanced distribution of the recesses in the sliding surface and ease of manufacturing.

While a regular array pattern is formed in the sliding surface in the sliding member 101*a*, 101*b*, the recesses may be arrayed in such a way that a part of the array pattern is missing, as long as the effect according to the exemplary embodiment of the invention is not impaired.

The distance by which to move the central points may be determined in accordance with the distance between the grid points of each basic grid along a direction orthogonal to the sliding direction, and the diameter of the recesses. For example, in the sliding member 101*a*, 101*b*, the diameter of the recesses is ⅓ of the distance between the grid points of each basic grid. If the diameter of the recesses is larger than this value, the distance by which to move the central points in order to satisfy the condition (2) mentioned above, i.e., at least one recess 112B be placed over the entire width of the sliding surface when the sliding surface is viewed along the sliding direction, may be small.

When the distance between the grid points in a direction orthogonal to the sliding direction is not more than three times or approximately three times the diameter of the recesses as described above, as in the sliding member 101*a* or 101*b*, the manner of displacing the central points may be simplified, thereby achieving a simplified array pattern. Also, the ease of manufacturing is also considered to improve as a result.

The term "diameter of the recesses" refers to the maximum direction of the recesses in a direction orthogonal to the sliding direction.

Further, while each basic grid in the sliding member 101*a*, 101*b* illustrated in FIG. 1, 2 is a square, the shape of the basic grid is not limited to this shape. The shape may be a rectangle, a parallelogram, or a rhombus as long as its one side is parallel to the sliding direction.

Layer Structure of the Sliding Member

Next, the layer structure of the sliding member according to the exemplary embodiment is described.

Sliding members 101*c* and 101*d* illustrated in FIGS. 3A and 3B each include a sheet-like substrate 110, and a fluororesin layer 112 provided on top of the substrate 110 (the adhesive layer for adhesion between the substrate 110 and the fluororesin layer 112 is not illustrated).

A sliding member 101*e* illustrated in FIG. 3C has the fluororesin layer 112 laminated on top of the sheet-like substrate 110 via a fluororesin fiber layer 114 (the adhesive layers for adhesion between the substrate 110 and the fluororesin fiber layer 114, and between the fluororesin fiber layer 114 and the fluororesin layer 112 are not illustrated).

As can be appreciated from its cross-section, in the sliding member 101*c* illustrated in FIG. 3A, the recesses 112B are defined by the fluororesin layer 112 alone.

In the sliding member 101*d* illustrated in FIG. 3B, the fluororesin layer 112 has through-holes that extend through the layer in the thickness direction, and the recesses 112B are defined by the through-holes and the surface of the substrate 110. Also, in the sliding member 101*e* illustrated in FIG. 3C, the recesses are defined by through-holes in the fluororesin layer 112, and the surface of the substrate 110 via the fluororesin fiber layer 114.

In the case of the sliding members 101*d* and 101*e*, the depth of the recesses can be increased by adjusting the thickness of the fluororesin layer 112, thereby making it possible to enhance oil retention performance. In particular, the presence of the fluororesin fiber layer 114 between the fluororesin layer 112 and the substrate 110 in the sliding member 101*e* allows the sliding member 101*e* to retain even more oil than the sliding member 101*d*.

In each of the sliding members 101*c* to 101*e* according to the exemplary embodiment, the fluororesin layer 112 is laminated on top of the substrate 110, and the fluororesin layer 112 that configures the sliding surface 112A is supported by the substrate 110.

This configuration reduces deformation of the fluororesin layer 112 due to the sliding movement between the sliding member and the member to be slid.

In a case where the recesses are defined by the fluororesin layer 112 alone as in the sliding member 101*c*, the substrate 110 is not necessarily required. As long as the fluororesin layer 112 has a sufficient thickness, the sliding member according to the exemplary embodiment may be a single-layer body configured by the fluororesin layer 112.

Specific Form of Recesses

The shape of the recesses formed in the sliding surface as viewed along a direction orthogonal to the sliding surface may be any shape such as a circle, an ellipse, a quadrangle (rectangle or another polygonal shape), or an irregular shape, as long as the recesses are able to exert their oil retention/supply function. From the viewpoint of ease of machining, the shape of the recesses may be a circle as illustrated in FIGS. 1 and 2.

Examples of the shape along the depth of the recesses as viewed in cross-section as in FIGS. 3A to 3C include a columnar, conical, taper, or inverted taper shape.

The manner of arraying the recesses may satisfy the following conditions in addition to the conditions (1) and (2) mentioned above, from the viewpoints of durability of the sliding surface and influence on the image.

The area occupied per one recess in the sliding surface may be not less than $7\times10^{-3}$ mm$^2$ or approximately $7\times10^{-3}$ mm$^2$ and not more than 3.2 mm$^2$ or approximately 3.2 mm$^2$ (preferably not less than 0.03 mm$^2$ and not more than 0.8 mm$^2$).

Specifically, in a case where the shape of the recesses in the sliding surface is a circle, the diameter of the circle may be not less than 100 μm and not more than 2 mm (preferably not less than 150 μm and not more than 1 mm).

Also, in the sliding surface, the period (array pitch) of the recesses, that is, the center-to-center distance between adjacent recesses may be not less than 0.2 mm or approximately 0.2 mm and not more than 2.0 mm or approximately 2.0 mm (preferably not less than 0.3 mm and not more than 1.5 mm).

In particular, from the viewpoint of reducing influence on the image while maintaining oil retention/supply performance, the area per one recess may be within the above-mentioned range, and the period of the recesses may be within the above-mentioned range.

Further, the ratio of the area occupied by all the recesses to the total area of the sliding surface may be not less than 10% or approximately 10% and not more than 60% or approximately 60% (preferably not less than 15% and not more than 40%, more preferably not less than 20% and not more than 30%).

Setting the area occupied by the recesses in the sliding surface within the above-mentioned range may make it possible to obtain the oil retention/supply function while ensuring wear resistance.

The distance between the grid points in each basic grid along a direction orthogonal to the sliding direction, and the diameter of the recesses may be determined in accordance with the above-mentioned area.

Next, a member that configures the sliding member according to the exemplary embodiment is described in detail.

First, the fluororesin layer having the sliding surface which configures the sliding member is described.

The fluororesin layer may be any layer that contains fluororesin as its principal constituent. The fluororesin layer may contain an additive such as a filler as required.

Examples of the resin that configures the fluororesin layer include polytetrafluoroethylene, perfluoroalkoxy alkane, and ethylene-tetrafluoroethylene copolymer.

Among these, as the fluororesin layer 112, a layer containing cross-linked fluororesin as its principal constituent is preferred, in particular, a layer made of cross-linked polytetrafluoroethylene (hereinafter, referred to as "cross-linked PTFE") is preferred.

The cross-linked PTFE that configures the fluororesin layer is, for example, cross-linked PTFE obtained by crosslinking un-crosslinked PTFE by radiating ionizing rays.

Specifically, the cross-linked PTFE is obtained by, for example, crosslinking un-crosslinked PTFE heated at a temperature higher than the crystalline melting point, by radiating ionizing rays (e.g., γ-rays, electron rays, X-rays, neutron rays, or high energy ions) with a radiation dose of not less than 1 KGy and not more than 10 MGy under the absence of oxygen.

The PTFE may contain a copolymerized component other than tetrafluoroethylene (such as perfluoro(alkylvinyl ether), hexafluoropropylene, (perfluoroalkyl)ethylene, or chlorotrifluoroethylene).

The filler and other additives are described.

The filler is added for the purposes of imparting electrical conductivity and improving durability and thermal conductivity.

The kind of the filler may be at least one kind selected from the group including metal oxide particles, silicate mineral, carbon black, and a nitrogen compound.

Among these, ketchen black, graphite, and acetylene black are preferred for imparting electrical conductivity, and graphite, copper, silver, aluminum nitride, boron nitride, aluminum, and the like are preferred for imparting thermal conductivity. One kind of filler material may be used alone, or two or more kinds of filler materials may be used in combination.

The average grain size of the filler may be not less than 0.01 μm and not more than 20 μm, for example.

In the case of using a filler, its content may be not less than 0.01 part by mass and not more than 30 parts by mass with respect to 100 parts by mass of the fluororesin component, for example.

The fluororesin layer may contain additives other than a filler as suited to the intended purpose.

The thickness of the fluororesin layer may be set in accordance with the rigidity of the layer, the kind or shape of the substrate placed adjacent to the layer, and the like. Normally, the thickness of the fluororesin layer is set within the range of 20 μm to 500 μm (preferably not less than 50 μm and not more than 400 μm).

In a case where the sliding member according to the exemplary embodiment is configured by a single-layer body of fluororesin layer, the thickness of the fluororesin layer may be set within a range not less than 200 μm and not more than 400 μm from the viewpoints of shape retention, durability, and the like.

Next, the sheet-like substrate is described.

The sheet-like substrate contains, for example, a resin material, and an additive such as a filler as required.

Examples of the resin material include polyimide resin, polyamide resin, polyamide-imide resin, polyether etherester resin, polyallylate resin, polyester resin, and polyester resin added with a reinforcing material. Among these, polyimide resin is preferred for its high heat resistance and mechanical strength.

The thickness of the sheet-like substrate is set within a range not less than 50 μm and not more than 150 μm (preferably not less than 60 μm and not more than 130 μm), for example.

Next, the fluororesin fiber layer is described.

The fluororesin fiber layer is a layer of fiber that is present between the substrate and the fluororesin layer having through-holes. Since the fluororesin fiber layer has the function of retaining oil within the layer, the oil that exists within each through-hole moves via the fluororesin fiber layer. As a result, the sliding member 101*e* exhibits superior oil retention performance, and also superior in-plane uniformity.

As the fluororesin fiber layer, for example, PTFE fiber or heat-resistant aramid fiber is used. Of these, the PTFE fiber is preferred for its high heat resistance and high adhesiveness with the fluororesin layer configured by crosslinked PTFE.

Specifically, as the PTFE fiber, Gore fiber cloth FS120-E (product name) (manufactured by W. L. Gore & Associates, Inc; thickness: 120 μm) is used.

Further, an adhesive layer is described.

An adhesive layer exists for adhesion between the substrate and the fluororesin layer, between the substrate and the fluororesin fiber layer, and further, between the fluororesin fiber layer and the fluororesin layer.

Such an adhesive layer may be formed using an existing adhesive such as heat-resistant silicone resin or epoxy-based resin, or may be forming using an adhesive sheet.

For example, in a case where through-holes are formed in the fluororesin layer, an adhesive sheet may be used for the adhesion between this fluororesin layer and the substrate in such a way that the through-holes are not filled in by the adhesive sheet. In this case, an adhesive sheet with holes having the same shape as the through-holes in the fluororesin layer may be used.

Also, as the adhesive layer used for the adhesion between the fluororesin fiber layer and the fluororesin layer in which through-holes are formed, an adhesive sheet with holes having the same shape as the through-holes in the fluororesin layer may be used so that the through-hole is not filled in by the adhesive sheet.

As the adhesive sheet mentioned above, a fluorine-based adhesive sheet is used, which undergoes thermal fusion when heated to temperatures higher than or equal to the melting point to thereby enable adhesion between the substrate and the fluororesin layer, between the substrate and the fluororesin fiber layer, and between the fluororesin fiber layer and the fluororesin layer. In particular, such a fluorine-based adhesive sheet may be used because of the absence of interaction with oil and its ability to reduce degradation due to oil.

Specifically, as the fluorine-based adhesive sheet, Silky Bond (product name) (manufactured by Junkosha Inc.) is used.

Also, the thickness of the adhesive sheet is set within a range not less than 10 μm and not more than 30 μm.

Manufacturing Method

A method of manufacturing each of the sliding members 101*c* to 101*e* according to the exemplary embodiment is described.

First, in the case of the sliding member 101*c* and the sliding member 101*d*, a sheet that serves as the substrate 110, and the fluororesin layer 112 are prepared. In the case of the sliding member 101*e*, in addition to these components, a sheet that serves as the fluororesin fiber layer 114 is prepared.

Next, recesses or through-holes are formed in the fluororesin layer 112.

Embossing can be used as a method of forming the recesses in the fluororesin layer.

The embossing used to form recesses at this time is a method of, for example, obtaining an intended shape by applying pressure after heating the fluororesin layer 112 to a temperature higher than or equal to the glass transition temperature of the fluororesin (e.g., crosslinked PTFE) that configures the fluororesin layer 112.

Specifically, this embossing forms recesses in the sliding surface 112A by pressing a die against the sliding surface 112A of the fluororesin layer 112. This die has cylindrical protrusions corresponding to the recesses to be formed, on the pressing surface to be pressed against the sliding surface 112A of the fluororesin layer 112.

While such a die is often fabricated by a numerically controlled (NC) machine tool or the like, in the case of forming recesses in the sliding surface 112A of the fluororesin layer 112, the die may be fabricated by etching of a metal. However, fabricating a die by etching introduces a taper in the depth direction and hence is sometimes difficult to control.

Examples of the method of fabricating a die with particularly good precision include use of Ni electrocasting or use of a combination of Ni electrocasting and photolithography (electroforming). Such fabrication methods are favorable in terms of cost and precision, and ease of replication.

Laser machining, machining using a drill, punching using a die, or the like is used to form through-holes in the fluororesin layer 112. Punching may be used when the hole diameter is relatively large (e.g., more than 0.3 mm), and laser may be used when the hole diameter is small (e.g., less than 0.5 mm).

At this time, a $CO_2$ laser, a excimer layer, or the like is used for the laser machining.

In the case of manufacturing the sliding member 101*e*, through-holes are also formed in the fluorine-based adhesive sheet.

The formation of through-holes is performed in the same manner as the formation of through-holes in the fluororesin layer 112. The shape and position of the through-holes in the fluorine-based adhesive sheet are set so that the through-holes in the fluororesin layer 112 and the through-holes in the fluorine-based adhesive sheet communicate with each other when laminated together. The diameter of the through-holes formed in the fluorine-based adhesive sheet may be the same as that of the through-holes in the fluororesin layer 112, or may be slightly larger than that of the through-holes in the fluororesin layer 112 as long as there is no problem in terms of adhesion strength.

The fluorine-based adhesive sheet used in the manufacture of the sliding member 101*d* may or may not be provided with through-holes.

Subsequently, in the case of the sliding member 101*c*, 101*d*, the sheet serving as the substrate 110 and the fluororesin layer 112 having recesses or through-holes are bonded together by using a fluorine-based adhesive sheet.

This bonding is performed as follows. First, the fluorine-based adhesive sheet is sandwiched between the sheet serving as the substrate 110 and the fluororesin layer 112 having recesses or through-holes, in other words, a laminate including the sheet serving as the substrate 110 and the fluororesin layer 112 with recesses or through-holes is formed. Then, pressure is applied from above and below the laminate, further followed by heating.

In the case of the sliding member 101*e*, the sheet serving as the substrate 110 and the sheet serving as the fluororesin fiber layer 114 are bonded together by using a fluorine-based adhesive sheet (without through-holes), and the sheet serving as the fluororesin fiber layer 114 and the fluororesin layer 112 having recesses or through-holes are bonded together by using a fluorine-based adhesive sheet with through-holes.

This bonding is performed as follows. First, a laminate including the sheet serving as the substrate 110, the fluorine-based adhesive sheet without through-holes, the sheet serving as the fluororesin fiber layer 114, the fluorine-based adhesive sheet with through-holes, and the fluororesin layer 112 with recesses or through-holes is formed. Then, pressure is applied from above and below the laminate, further followed by heating.

The pressure applied to the laminate at the time of the bonding mentioned above may be set within a range not less than 1.0 MPa and not more than 2.0 MPa, and the heating temperature may be set within a range not less than 320 degrees and not more than 350 degrees.

Each of the sliding members 101*c* to 101*e* according to the exemplary embodiment is manufactured through the above-mentioned steps.

Each of the sliding members 101*c* to 101*e* according to the exemplary embodiment described above is a skeet-like member having at least the sheet-like substrate 110 and the fluororesin layer 112. The sliding member may be also configured as follows.

That is, the substrate may be configured by a pressing member (pressing pad) made of metal. A sliding pad having a fluororesin layer with recesses or through-holes corresponding to the recesses that satisfy the conditions (1) and (2) mentioned above, which is placed on the surface of this substrate, is also an example of the sliding member according to the exemplary embodiment. For example, as described in Proceedings of the 107th Imaging Conference JAPAN 2011, a peeling pad inside a fixing device installed in Color 1000/800 Press manufactured by Fuji Xerox Co., Ltd. exists as such a sliding pad.

Fixing Device

Hereinafter, a fixing device according to the exemplary embodiment is described.

The fixing device according to the exemplary embodiment can take various forms. Hereinafter, a fixing device including a heat roller having a heat source, and a pressure belt against which a pressing pad is pressed is described as a first exemplary embodiment, and a fixing device having a heat belt against which a heat source is pressed, and a pressure roller is described as a second exemplary embodiment.

The sliding member according to the exemplary embodiment described above is applied to a sheet-like sliding member in each of these fixing devices.

In this regard, the inner surface (inner periphery) of the heat belt or pressure belt may have a surface roughness Ra of not less than 0.1 μm or approximately 0.1 μm and not more than 2.0 μm or approximately 2.0 μm (preferably not less than 0.3 μm and not more than 1.5 μm), for example. The heat belt or pressure belt is an example of second rotary body in which the sliding member according to the exemplary embodiment is placed, and with which the sliding surface of the sliding member is brought into contact.

As a result, the sliding resistance between the heat belt or pressure belt as an example of second rotary body, and the sliding member decreases. In a case where a lubricant (oil) is provided between these members, in particular, retention of the lubricant (oil) between these members is facilitated, thereby improving the wear resistance of the sliding member.

The surface roughness Ra is measured by using a surface roughness tester Surfcom 1400A (manufactured by Tokyo Seimitsu Co., Ltd.) in compliance with JIS B0601-1994, under the conditions of an evaluation length Ln of 4 mm, a reference length L of 0.8 mm, and a cut-off value of 0.8 mm.

First exemplary embodiment of the fixing device

Figure 4:
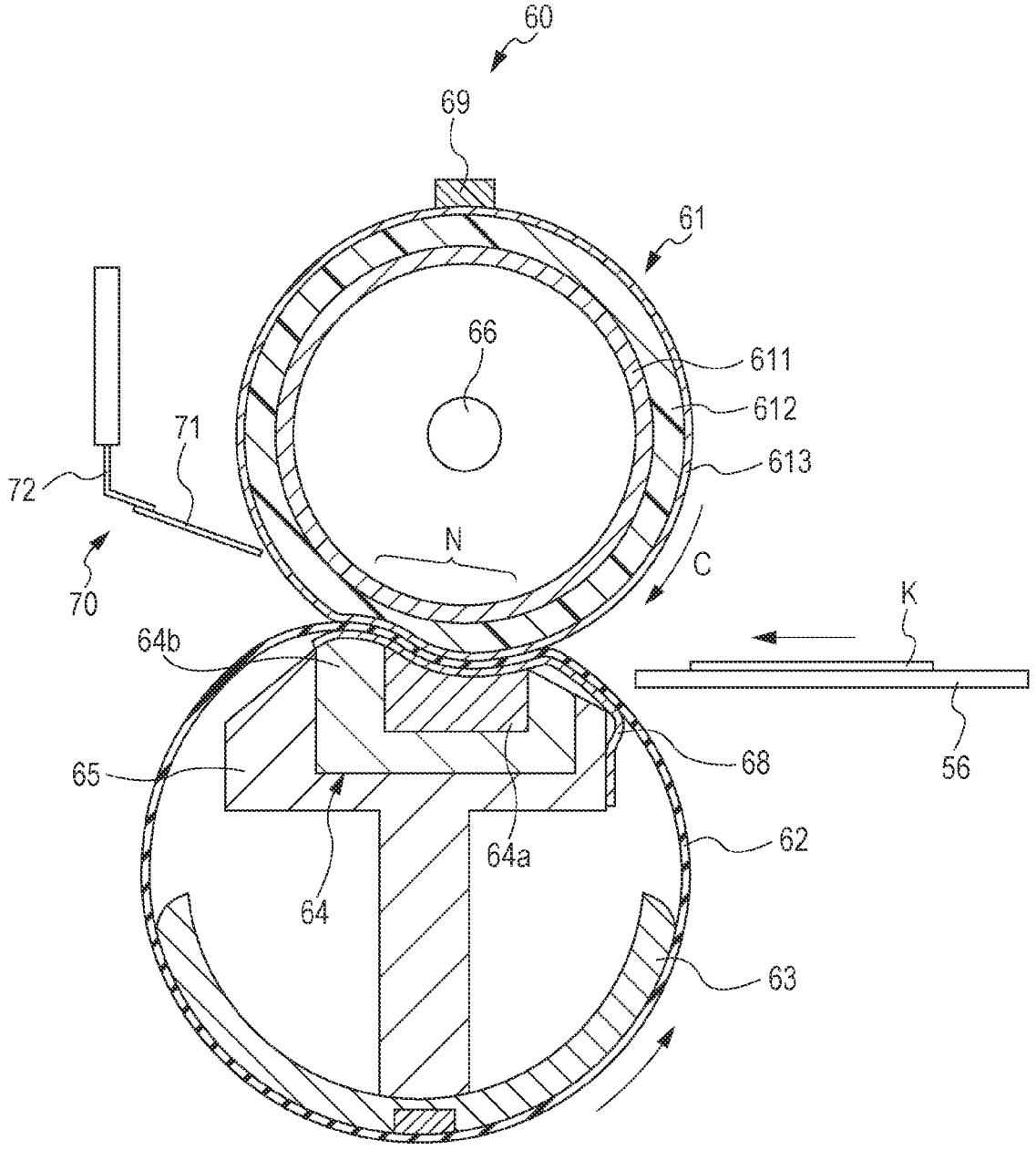
FIG. 4 schematically illustrates the configuration of a fixing device according to a first exemplary embodiment.

First, a fixing device 60 according to the first exemplary embodiment is described. FIG. 4 schematically illustrates the configuration of the fixing device 60 according to the first exemplary embodiment.

As illustrated in FIG. 4, the fixing device 60 according to the first exemplary embodiment includes, for example, a heat roller 61, a pressure belt 62, and a pressing pad 64. The heat roller 61 is an example of first rotary body that is rotationally driven. The pressure belt 62 is an example of second rotary body. The pressing pad 64 is an example of pressing member that presses the heat roller 61 via the pressure belt 62.

The pressing pad 64 may be configured in any way as long as the pressing pad 64 presses the pressure belt 62 and the heat roller 61 relative to each other. Accordingly, the pressure belt 62 may be pressed against the heat roller 61, or the heat roller 61 may be pressed against the heat roller 61.

The heat roller 61 is configured by, for example, a heat-resistant elastic body layer 612 and a release layer 613 that are laminated around a core made of metal (cylindrical cored bar) 611. A halogen lamp 66 as an example of heating section is arranged inside the heat roller 61. The heating section is not limited to a halogen lamp but another heat generating member may be used.

For example, a temperature-sensitive element 69 is placed in contact with the surface of the heat roller 61. Lighting of the halogen lamp 66 is controlled on the basis of the value of temperature measured by the temperature-sensitive element 69, thereby keeping the surface temperature of the heat roller 61 at a preset temperature (e.g., 150° C.).

The pressure belt 62 is, for example, rotatably supported by the pressing pad 64 and a belt travel guide 63 that are placed inside the pressure belt 62. In a nip region N (nip part), the pressure roller 62 is pressed against the heat roller 61 by the pressing pad 64.

For example, the pressing pad 64 is placed inside the pressure belt 62 so as to be pressed against the heat roller 61 via the pressure belt 62. The pressing pad 64 defines the nip region N together with the heat roller 61.

The pressing pad 64 has a front nip member 64*a* that is placed on the entrance side of the nip region N in order to secure a wide nip region N, and a peeling nip member 64*b* that is placed on the exit side of the nip region N in order to apply distortion to the heat roller 61.

In order to reduce the sliding resistance between the inner periphery of the pressure belt 62 and the pressing pad 64, for example, a sheet-like sliding member 68 is provided on the side of the front nip member 64*a* and the peeling nip member 64*b* that contacts the pressure belt 62. The pressing pad 64 and the sliding member 68 are held by a holding member 65 made of metal.

For example, the sliding member 68 is provided in such a way that its sliding surface contacts the inner surface of the pressure belt 62. The sliding member 68 is involved in retention/supply of oil that is present between the sliding member 68 and the pressure belt 62. As mentioned above, the sliding member according to the exemplary embodiment exhibits superior performance in terms of wear resistance and oil retention/supply. Since the sliding member may keep the coefficient of friction with the pressure belt 62 (the member to be slid) inside the fixing device from increasing even after prolonged, continued use, the life of the fixing device may be extended.

The holding member 65 is attached with the belt travel guide 63, for example, thus allowing the pressure belt 62 to rotate.

For example, the heat roller 61 rotates in the direction of an arrow C by a drive motor (not illustrated). Following this rotation, the pressure belt 62 rotates in a direction opposite to the direction of rotation of the heat roller 61. In other words, for example, the heat roller 61 rotates in the clockwise direction in FIG. 4, whereas the pressure belt 62 rotates in the counter-clockwise direction.

A sheet of paper K (recording medium) with an unfixed toner image is guided by, for example, an entry guide 56, and transported to the nip region N. Then, as the paper K passes through the nip region N, the toner image on the paper K is fixed by the pressure and heat acting on the nip region N.

In the fixing device 60 according to the first exemplary embodiment, for example, a wide nip region N is secured owing to the front nip member 64*a* having a recessed shape that conforms to the outer periphery of the heat roller 61, as compared with a case where the front nip member 64*a* is not provided.

Also, in the fixing device 60 according to the first exemplary embodiment, for example, the peeling nip member 64*b* is placed in a projecting fashion with respect to the outer periphery of the heat roller 61, thereby increasing local distortion of the heat roller 61 in the exit region of the nip region N.

When the peeling nip member 64*b* is placed in this way, for example, as the paper K with a fixed image passes through the peeling nip region, the paper K passes through an area of increased local distortion, thus allowing the paper K to easily peel from the heat roller 61.

As an auxiliary peeling section, for example, a peeling member 70 is arranged on the downstream side of the nip region N of the heat roller 61. The peeling member 70 is held by a holding member 72 in such a way that a peeling claw 71 is located in close proximity to the heat roller 61 in a direction counter to the rotational direction of the heat roller 61.

Second Exemplary Embodiment of the Fixing Device

Figure 5:
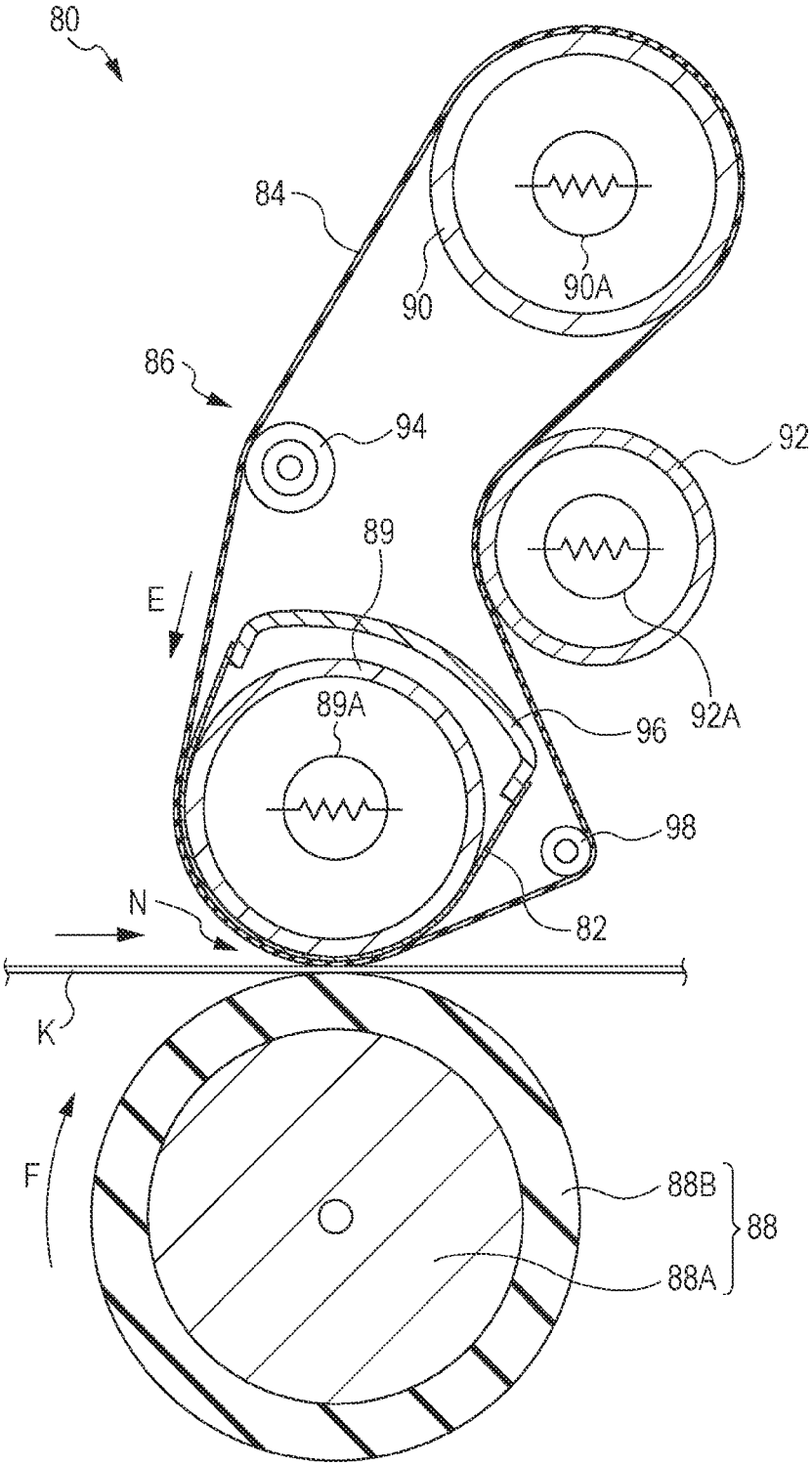
FIG. 5 schematically illustrates the configuration of a fixing device according to a second exemplary embodiment.

Next, a fixing device 80 according to the second exemplary embodiment is described. FIG. 5 schematically illustrates the configuration of the fixing device according to the second exemplary embodiment.

As illustrated in FIG. 5, the fixing device 80 according to the second exemplary embodiment includes a fixing belt module 86 and a pressure roller 88. The fixing belt module 86 includes a heat belt 84 as an example of second rotary body. The pressure roller 88 is an example of first rotary body placed so as to be pressed against the heat belt 84 (the fixing belt module 86). For example, a nip region N (nip part) where the heat belt 84 (the fixing belt module 86) and the pressure roller 88 contact each other is defined in the fixing device 80. In the nip region N, pressure and heat are applied to a sheet of paper K as an example of recording medium, thereby fixing a toner image to the paper K.

The fixing belt module 86 includes, for example, the heat belt 84 that is an endless belt, a heat pressing roller 89, and a support roller 90. The heat belt 84 is wound around the heat pressing roller 89 on the pressure roller 88 side. The heat pressing roller 89 is rotationally driven by the torque of a motor (not illustrated), and presses the heat belt 84 against the pressure roller 88 side from the inner surface of the heat belt 84. The support roller 90 supports the heat belt 84 from the inside at a position different from the heat pressing roller 89.

The fixing belt module 86 is provided with, for example, a support roller 92, an orientation-correcting roller 94, and a support roller 98. The support roller 92 is placed outside the heat belt 84 and defines the revolution path of the heat belt 84. The orientation-correcting roller 94 corrects the orientation of the portion of the heat belt 84 between the heat pressing roller 89 and the support roller 90. The support roller 98 applies tension to the heat roller 84 from its inner surface on the downstream side of the nip region N where the heat belt 84 (the fixing belt module 86) and the pressure roller 88 contact each other.

The fixing belt module 86 is provided in such a way that, for example, a sheet-like sliding member 82 lies between the heat belt 84 and the heat pressing roller 89.

The sliding member 82 is provided in such a way that, for example, its sliding surface contacts the inner surface of the heat belt 84. The sliding member 82 is involved in retention/supply of oil that is present between the sliding member 82 and the heat belt 84. As mentioned above, the sliding member according to the exemplary embodiment exhibits superior performance in terms of wear resistance and oil retention/supply. Since the sliding member may keep the coefficient of friction with the heat belt 84 (the member to be slid) inside the fixing device from increasing even after prolonged, continued use, the life of the fixing device may be extended.

The sliding member 82 is provided with its ends being supported by a support member 96, for example.

The heat pressing roller 89 is a hard roller having a fluororesin coating as a protective layer for preventing metal wear of the surface of a cylindrical cored bar made of aluminum. The fluororesin coating has a basis weight of 200 μm and is formed on the surface of the cored bar.

Inside the heat pressing roller 89, for example, a halogen heater 89A is provided as an example of heat source.

The support roller 90 is a cylindrical roller made of aluminum. Inside the support roller 90, a halogen heater 90A is arranged as an example of heat source, thereby heating the heat belt 84 from the inner surface side.

At either end of the support roller 90, for example, a spring member (not illustrated) is arranged to press the heat roller 84 outwards.

The support roller 92 is, for example, a cylindrical roller made of aluminum. A release layer made of fluororesin with a thickness of 20 μm is formed on the surface of the support roller 92.

The release layer of the support roller 92 is provided for the purpose of, for example, preventing toner or paper dust from the outer periphery of the heat belt 84 from building up on the support roller 92.

Inside the support roller 92, for example, a halogen heater 92A is provided as an example of heat source, thereby heating the heat belt 84 from the outer periphery side.

That is, for example, the heat belt 84 is heated by the heat pressing roller 89, the support roller 90, and the support roller 92.

The orientation-correcting roller 94 is, for example, a cylindrical roller made of aluminum. An end position measuring mechanism (not illustrated) that measures the end position of the heat belt 84 is placed near the orientation-correcting roller 94.

For example, an axial displacement mechanism (not illustrated) is arranged in the orientation-correcting roller 94. The axial displacement mechanism displaces the abutment position along the axial direction of the heat belt 84 in accordance with the measurement results from the end position measuring mechanism, thereby controlling meandering of the heat belt 84.

The pressure roller 88 includes, for example, a cylindrical roller 88A made of aluminum as a substrate, and an elastic layer 88B and a release layer that are laminated in this order from the substrate side. The elastic layer 88B is made of silicon rubber. The release layer includes fluororesin with a film thickness of 100 μm. The pressure roller 88 is rotatably supported in place, and is pressed by an urging section such as a spring (not illustrated) against the area where the heat belt 84 is wound around the heat pressing roller 89. Therefore, as the heat belt 84 (the heat pressing roller 89) of the fixing belt module 86 rotates in the direction of an arrow E, the pressure roller 88 rotates in the direction of an arrow F following the heat belt 84 (the heat pressing roller 89).

Then, the paper K with an unfixed toner image is guided to the nip region N of the fixing device 80. The toner image is fixed to the paper K by the pressure and heat acting on the nip region N.

Image Forming Apparatus

Next, an image forming apparatus according to the exemplary embodiment is described.

Figure 6:
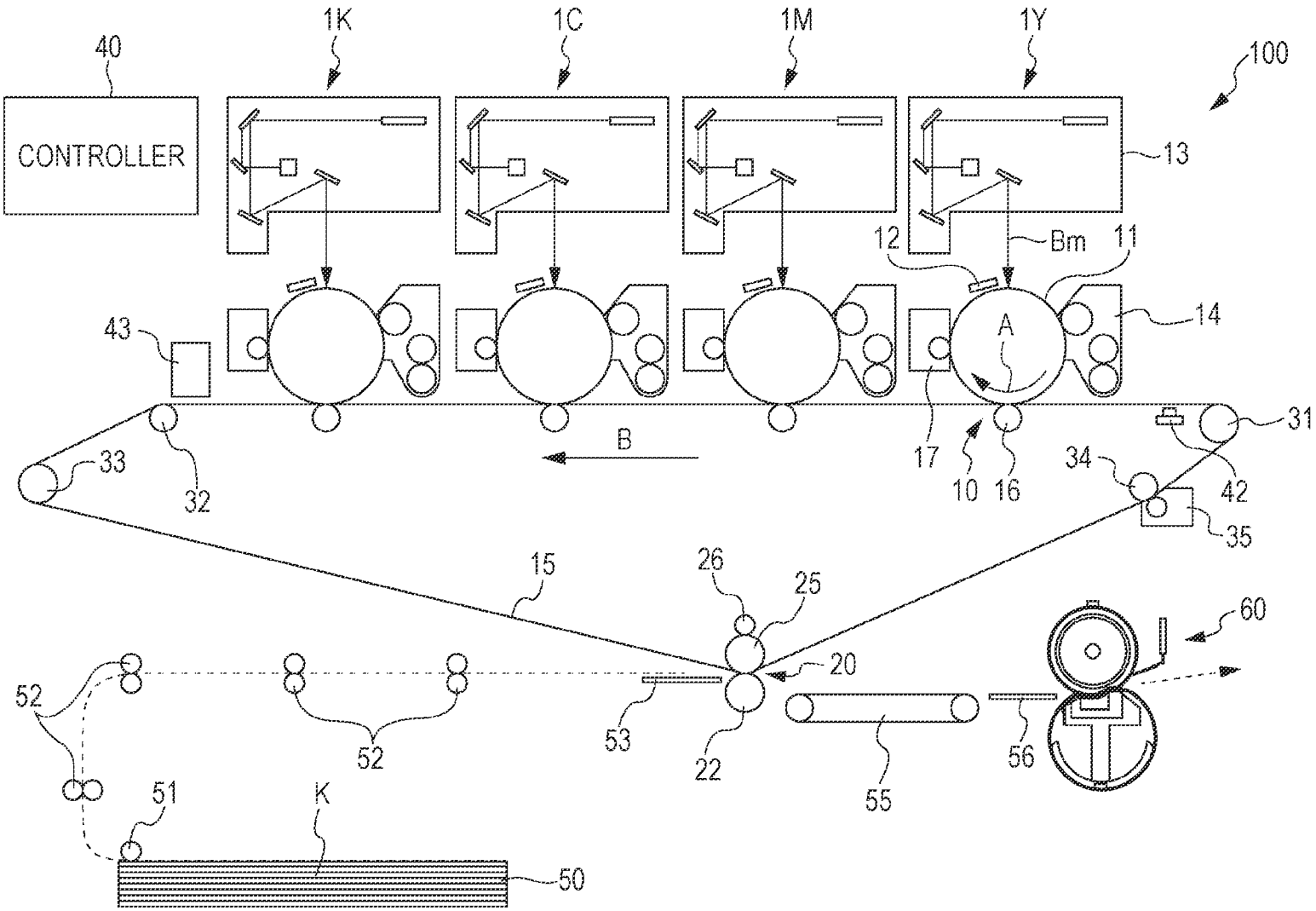
FIG. 6 schematically illustrates the configuration of an image forming apparatus according to the exemplary embodiment.

FIG. 6 schematically illustrates the configuration of the image forming apparatus according to the exemplary embodiment.

The fixing device according to the exemplary embodiment mentioned above is applied to the image forming apparatus according to the exemplary embodiment.

As illustrated in FIG. 6, an image forming apparatus 100 according to the exemplary embodiment is an image forming apparatus employing an intermediate transfer system which is generally called a tandem type. The image forming apparatus 100 includes multiple image forming units 1Y, 1M, 1C, and 1K, a first transfer section 10, a second transfer section 20, and the fixing device 60. In the image forming units 1Y, 1M, 1C, and 1K, toner images of various color components are formed by electrophotography. The first transfer section 10 sequentially transfers the toner images of various color components formed by the image forming units 1Y, 1M, 1C, and 1K to an intermediate transfer belt 15 (first transfer). The second transfer section 20 transfers the superimposed toner images transferred onto the intermediate transfer belt 15, to a sheet of paper K that is a recording medium at once (second transfer). The fixing device 60 fixes each of the images obtained after second transfer onto the paper K. The image forming apparatus 100 also has a controller 40 that controls the operations of various devices (various sections).

The fixing device 60 corresponds to the fixing device 60 according to the first exemplary embodiment described above. The fixing device has the sliding member 68 according to the exemplary embodiment mentioned above. The image forming apparatus 100 may be also configured to include the fixing device 80 according to the second exemplary embodiment described above (the sliding member 82 according to the exemplary embodiment mentioned above).

The image forming units 1Y, 1M, 1C, and 1K of the image forming apparatus 100 each include a photoconductor 11. The photoconductor 11 is an example of image carrier that holds a toner image formed on its surface. The photoconductor 11 rotates in the direction of an arrow A.

A charging unit 12 and a laser exposure unit 13 (the exposure beam is denoted by a symbol Bm in FIG. 5) are provided around the photoconductor 11. The charging unit 12 is an example of charging section that charges the surface of the image carrier. The charging unit 12 electrically charges the photoconductor 11. The laser exposure unit 13 is an example of latent image forming section that forms a latent image on the surface of the image carrier that has been charged by the charging section. The laser exposure unit 13 writes an electrostatic latent image onto the photoconductor 11.

Also, a developing unit 14 and a first transfer roller 16 are provided around the photoconductor 11. The developing unit 14 is an example of developing section that develops a latent image formed on the surface of the image carrier by the latent image forming section, with a toner to form a toner image. The developing unit 14 stores toners of various color components, and renders an electrostatic latent image on the photoconductor 11 visible with the corresponding toner. The first transfer roller 16 transfers toner images of various color components formed on the photoconductor 11 to the intermediate transfer belt 15 in the first transfer section 10.

Further, a photoconductor cleaner 17 is provided around the photoconductor 11. The photoconductor cleaner 17 removes toner remaining on the photoconductor 11. Electrophotographic devices including the charging unit 12, the laser exposure unit 13, the developing unit 14, the first transfer roller 16, and the photoconductor cleaner 17 are sequentially arranged along the rotational direction of the photoconductor 11. The image forming units 1Y, 1M, 1C, and 1K corresponding to these components are placed substantially linearly from the upstream side of the intermediate transfer belt 15 in the order of yellow (Y), magenta (M), cyan (C), and black (K).

The intermediate transfer belt 15 is configured by a film-like pressure belt having resin such as polyimide or polyamide as a base layer and containing an appropriate amount of antistatic agent such as carbon black. The intermediate transfer belt 15 has a volume resistivity of not less than $10^6$ Ωcm and not more than $10^{14}$ Ωcm, and a thickness of, for example, approximately 0.1 mm.

The intermediate transfer belt 15 is driven to circulate (rotate) at a predetermined speed in a direction B illustrated in FIG. 6 by various rollers. The various rollers include a drive roller 31, a support roller 32, a tension-applying roller 33, a back roller 25, and a cleaning back roller 34. The drive roller 31 is driven by a motor (not illustrated) with good constant velocity property and rotates the intermediate transfer belt 15. The support roller 32 supports the intermediate transfer belt 15 that extends substantially linearly along the array direction of each photoconductor 11. The tension-applying roller 33 applies a predetermined tension to the intermediate transfer belt 15, and functions as a correction roller that prevents meandering of the intermediate transfer belt 15. The back roller 25 is provided in the secondary transfer section 20. The cleaning back roller 34 is provided in a cleaning section that scrapes off toner remaining on the intermediate transfer belt 15.

The first transfer section 10 is configured by the first transfer roller 16 that faces the photoconductor 11 across the intermediate transfer belt 15. The first transfer roller 16 includes a shaft, and a sponge layer as an elastic layer secured around the shaft. The shaft is a cylindrical bar made of metal such as iron or SUS. The sponge layer is formed of a blended rubber of NBR, SBR, and EPDM in which a conductive agent such as carbon black is blended. The sponge layer is a sponge-like cylindrical roller with a volume resistivity of not less than $10^{7.5}$ Ωcm and not more than $10^{8.5}$ Ωcm.

The first transfer roller 16 is placed in press contact with the photoconductor 11 across the intermediate transfer belt 15.

Further, the first transfer roller 16 is applied with a voltage (a first transfer bias) of a polarity opposite to the polarity of the charge on the toner (hereinafter referred to as "negative polarity"). Therefore, the toner images on the corresponding photoconductors 11 are electrostatically sucked onto the intermediate transfer belt 15 sequentially, forming superimposed toner images on the intermediate transfer belt 15.

The secondary transfer section 20 includes the back roller 25 and a second transfer roller 22. The second transfer roller 22 is an example of transfer section that transfers a toner image formed by the developing section to a recording medium. The second transfer roller 22 is placed on the toner image holding surface side of the intermediate transfer belt 15.

The surface of the back roller 25 is configured by a tube of blended rubber of EPDM and NBR in which carbon is dispersed. The inside of the back roller 25 is configured by EPDM rubber. The back roller 25 has a surface resistivity of not less than $10^{7.5}$ Ω/sq. and not more than $10^{10}$/sq. The hardness of the back roller 25 is set to, for example, 70° (ASKER C manufactured by Kobunshi Keiki Co., Ltd.; hereinafter the same). The back roller 25 is placed on the back side of the intermediate transfer belt 15, and configures a counter electrode for the second transfer roller 22. A power supply roller 26 is placed in contact with the back roller 25. The power supply roller 26 is made of metal, and stably applied with a second transfer bias.

The second transfer roller 22 includes a shaft, and a sponge layer as an elastic layer secured around the shaft. The shaft is a cylindrical bar made of metal such as iron or SUS. The sponge layer is formed of a blended rubber of NBR, SBR, and EPDM in which a conductive agent such as carbon black is blended. The sponge layer is a sponge-like cylindrical roller with a volume resistivity of not less than $10^{7.5}$ Ωcm and not more than $10^{8.5}$ Ωcm.

The second transfer roller 22 is placed in press contact with the back roller 25 across the intermediate transfer belt 15. Further, the second transfer roller 22 is grounded, and a second transfer bias is produced between the second transfer roller 22 and the back roller 25, thereby transferring a toner image onto the paper K transported to the second transfer section 20.

An intermediate transfer belt cleaner 35 is provided on the downstream side of the secondary transfer section 20 of the intermediate transfer belt 15. The intermediate transfer belt cleaner 35 is able to contact and separate from the intermediate transfer belt 15. The intermediate transfer belt cleaner 35 removes toner or paper dust remaining on the intermediate transfer belt 15 after second transfer, thereby cleaning the surface of the intermediate transfer belt 15.

A reference sensor (home position sensor) 42 is arranged on the upstream side of the image forming unit 1Y for yellow. The reference sensor 42 generates a reference signal that serves as a reference for establishing the timing of image formation in each of the image forming units 1Y, 1M, 1C and 1K. An image density sensor 43 for adjusting image quality is arranged on the downstream side of the image forming unit 1K for black. The reference sensor 42 recognizes a predetermined mark provided on the back side of the intermediate transfer belt 15, and generates a reference signal. The image forming units 1Y, 1M, 1C and 1K begin image formation upon instruction from the controller 40 based on the recognition of this reference signal.

Further, the image forming apparatus according to the exemplary embodiment includes a paper storing section 50, a paper feed roller 51, a transport roller 52, a transport guide 53, a transport belt 55, and the entry guide 56, as a transport section that transports the paper K. The paper storing section 50 stores the paper K. The paper feed roller 51 picks up and transports the paper K collected in the paper storing section 50 at predetermined timing. The transport roller 52 transports the paper L paid out by the paper feed roller 51. The transport guide 53 sends the paper K transported by the transport roller 52 to the second transfer section 20. The transport belt 55 transports the paper K transported to the transport belt 55 after second transfer by the second transport roller 22, to the fixing device 60. The entry guide 56 guides the paper K toward the fixing device 60.

Next, a basic image forming process by the image forming apparatus according to the exemplary embodiment is described.

In the image forming apparatus according to the exemplary embodiment, after predetermined image processing is applied by an image processing device (not illustrated) to image data outputted from an image reading device (not illustrated) or a personal computer (PC) (not illustrated), image formation is executed by the image forming units 1Y, 1M, 1C, and 1K.

The image processing device applies predetermined image processing to inputted reflectance data. The predetermined image processing includes various kinds of image editing such as shading correction, misregistration correction, brightness/color space conversion, gamma correction, frame erasure, color editing, and motion editing. The image data applied with the image processing is converted into color material gradation data of the four colors Y, M, C, and K, and then outputted to the laser exposure unit 13.

The laser exposure unit 13 radiates the exposure beam Bm emitted from, for example, a semiconductor laser to the photoconductor 11 of each of the image forming units 1Y, 1Y, 1M, and 1K, in accordance with the inputted color material gradation data. The surfaces of the respective photoconductors 11 of the image forming units 1Y, 1Y, 1M, and 1K are charged by the charging unit 12, followed by scanning and exposure by the laser exposure unit 13, forming electrostatic latent images. The formed electrostatic latent images are developed by the corresponding image forming units 1Y, 1M, 1C, and 1K as toner images of the colors Y, M, C, and Y, respectively.

The toner images formed on the photoconductors 11 of the image forming units 1Y, 1M, 1C and 1K are transferred onto the intermediate transfer belt 15 in the first transfer section 10 where each of the photoconductors 11 and the intermediate transfer belt 15 contact each other. More specifically, in the first transfer section 10, the first transfer roller 16 applies a voltage (a first transfer bias) of a polarity opposite to the polarity of the charge on the toner (negative polarity) to the base material of the intermediate transfer belt 15, and first transfer is performed by sequentially superimposing the toner images on the surface of the intermediate transfer belt 15.

After the toner images are sequentially transferred to the surface of the intermediate transfer belt 15 by first transfer, the intermediate transfer belt 15 moves so that the toner images are transported to the second transfer section 20. When the toner images are transported to the second transfer section 20, in the transport section, the paper feed roller 51 rotates in synchronization with the timing when the toner images are transported to the second transfer section 20, and a sheet of paper K of a predetermined size is supplied from the paper storing section 50. The paper K supplied from the paper feed roller 51 is transported by the transport roller 52, and reaches the second transfer section 20 via the transport guide 53. Before reaching the second transfer section 20, the paper K is stopped once, and a registration roller (not illustrated)

rotates in synchronization with the movement timing of the intermediate transfer belt 15 holding the toner images, thereby performing registration between the paper K and the toner images.

In the second transfer section 20, the second transfer roller 22 is pressed against the back roller 25 via the intermediate transfer belt 15. At this time, the paper K transported to the second transfer section 20 with synchronized timing is nipped between the intermediate transfer belt 15 and the second transfer roller 22. When a voltage (a second transfer bias) of the same polarity as the polarity (negative polarity) of the charge on the toner is applied from the power supply roller 26, a transfer field is formed between the second transfer roller 22 and the back roller 25. Then, the unfixed toner images held on the intermediate transfer belt 15 are electrostatically transferred onto the paper K at once in the second transfer section 20 where pressure is applied by the second transfer roller 22 and the back roller 25.

Thereafter, the paper K with the electrostatically transferred toner images is transported while being peeled from the intermediate transfer belt 15 by the second transfer roller 22, and transported to the transport belt 55 provided on the downstream side in the paper transport direction of the second transfer roller 22. The transport belt 55 transports the paper K to the fixing device 60 at an optimal transport speed for the fixing device 60. As each of the unfixed toner images on the paper K transported to the fixing device 60 undergoes a fixing process with application of heat and pressure by the fixing device 60, the toner image is fixed onto the paper K. Then, the paper K with the fixed image is transported to a paper output storing section (not illustrated) provided in an eject section of the image forming apparatus.

Toner remaining on the intermediate transfer belt 15 after transfer to the paper K is complete is transported to the cleaning section as the intermediate transfer belt 15 rotates. The toner is then removed from the intermediate transfer belt 15 by the cleaning back roller 34 and the intermediate transfer belt cleaner 35.

While the exemplary embodiment of the invention has been described above, the foregoing description is not intended to limit the invention to the above exemplary embodiment. It is needless to mention that various modifications, alterations, and improvements are possible, and the exemplary embodiment can be implemented in a number of ways consistent with the requirements of the invention.

While the exemplary embodiment is directed to the case of an electrophotographic image forming apparatus, the exemplary embodiment is not limited to this. The exemplary embodiment may be applied to an existing image forming apparatus employing a system other than electrophotography (such as an inkjet recording apparatus equipped with an endless belt for transporting paper).

EXAMPLES

While the exemplary embodiment is described in detail below by way of examples, the exemplary embodiment is by no means limited to these examples.

Example 1

A die with Ni electrocast cylinders having a region (50 mm×400 mm) is prepared. In the above-mentioned region, cylindrical projections with a diameter of 0.25 mm and a height of 0.1 mm form an array pattern in which the central point in each of basic arrays in a staggered grid form is displaced from the corresponding basic array by 0.125 mm in a direction orthogonal to the sliding direction. In each of the basic arrays, the distance (array pitch) between grid points in a square basic grid is 0.75 mm. This die is fabricated by electro fine forming.

Further, a laminate sheet (80 mm×400 mm) is prepared. The laminate sheet is obtained by bonding together a polyimide resin sheet with a thickness of 75 μm that serves as a substrate, and a crosslinked PTFE sheet (Xeron XF-1B) with a thickness of 0.1 mm that serves as a fluororesin layer.

The die is laid over the fluororesin layer surface of the laminate sheet, and embossing is applied by applying pressure under heating at 180° C. with a pressing machine.

As a result, a sheet-like sliding member is obtained. The sheet-like sliding member has circular recesses with a diameter of 0.25 mm as illustrated in FIG. 1 that form an array pattern in the planar sliding surface of the fluororesin layer. In the array pattern, the array pitch is 0.75 mm and the central point in each of basic arrays in a staggered grid form is displaced from the corresponding basic array by 0.125 mm in the direction orthogonal to the sliding direction.

The area occupied by the recesses in the sliding member obtained at this time is approximately 25% of the area of the sliding surface.

Example 2

A die with Ni electrocast cylinders having a region (50 mm×400 mm) is prepared. In the above-mentioned region, cylindrical projections with a diameter of 0.25 mm and a height of 0.1 mm form an array pattern in which the central point in each of basic arrays in a staggered grid form is displaced from the corresponding basic array by 0.125 mm (distance in a direction orthogonal to the sliding direction) diagonally with respect to the sliding direction. In each of the basic arrays, the distance (array pitch) between grid points in a square basic grid is 0.75 mm. This die is fabricated by electro fine forming.

Further, a laminate sheet (80 mm×400 mm) is prepared. The laminate sheet is obtained by bonding together a polyimide resin sheet with a thickness of 75 μm that serves as a substrate, and a crosslinked PTFE sheet (Xeron XF-1B) with a thickness of 0.1 mm that serves as a fluororesin layer.

The die is laid over the fluororesin layer surface of the laminate sheet, and embossing is applied by applying pressure under heating at 180° C. with a pressing machine.

As a result, a sheet-like sliding member is obtained. The sheet-like sliding member has circular recesses with a diameter of 0.25 mm as illustrated in FIG. 2 that form an array pattern in the planar sliding surface of the fluororesin layer. In the array pattern, the array pitch is 0.75 mm and the central point in each of basic arrays in a staggered grid form is displaced from the corresponding basic array by 0.125 mm (distance in the direction orthogonal to the sliding direction) diagonally with respect to the sliding direction.

The area occupied by the recesses in the sliding member obtained at this time is approximately 25% of the area of the sliding surface.

Example 3

A skeet-like sliding member is obtained in the same manner as in Example 1, except that a single-layer body of crosslinked PTFE sheet (Xeron XF-1B manufactured by Hitachi Cable, Ltd.) with a thickness of 0.3 mm is used instead of the laminate sheet used in Example 1. In the sliding member, circular recesses with a diameter of 0.25 mm form an array pattern. In the array pattern, the array pitch is 0.75 mm and the central point in each of basic arrays in a staggered grid form is displaced from the corresponding basic array by 0.125 mm in a direction orthogonal to the sliding direction.

Comparative Example 1

A sliding member (HGF-500-6 manufactured by Chukoh Chemical Industries. Ltd.) is prepared by laminating a PTFE sheet with a thickness of 0.02 mm on glass cloth. The sliding member has irregularities with a height of 0.02 mm in its sliding surface.

The area occupied by the recesses in the sliding member obtained at this time is approximately 85% of the area of the sliding surface.

Comparative Example 2

A laminate sheet is prepared. The laminate sheet is obtained by bonding together a polyimide resin sheet with a thickness of 75 μm that serves as a substrate, and a crosslinked PTFE sheet (Xeron XF-1B) with a thickness of 0.1 mm that serves as a fluororesin layer.

Cross marks are embossed onto this laminate sheet by using a stainless mesh (30 meshes with a line diameter of 0.22 mm) instead of a die, and applying pressure under heating at 180° C. with a pressing machine.

As a result, a sheet-lie sliding member is obtained. The sheet-like sliding member has, in the sliding surface of the fluororesin layer, patterns arrayed in a grid form with an irregular line width that ranges from 5 μm to 30 μm and becomes greater at the intersection of the cross marks, in such a way that the cross marks are partially contiguous with each other.

The area occupied by the recesses in the sliding member obtained at this time is approximately 45% of the area of the sliding surface.

Comparative Example 3

A die with Ni electrocast cylinders having a region (50 mm×400 mm) is prepared. In the above-mentioned region, cylindrical projections with a diameter of 0.25 mm and a height of 0.1 mm form a staggered grid array pattern. The array pattern include square basic grids with an array pitch of 0.75 mm in the sliding direction and an array pitch of 0.75 mm in a direction orthogonal to the sliding direction. This die is fabricated by electro fine forming.

Further, a single-layer body (80 mm×400 mm) of crosslinked PTFE sheet (Xeron XF-1B manufactured by Hitachi Cable, Ltd.) with a thickness of 0.3 mm is prepared. The die is laid over the fluororesin layer surface of the crosslinked PTFE sheet, and embossing is applied by applying pressure under heating at 180° C. with a pressing machine.

As a result, a sheet-like sliding member is obtained. The sheet-like sliding member has circular recesses with a diameter of 0.25 mm that have a staggered grid array pattern in the planar sliding surface of the fluororesin layer. The array pattern includes square basic grids with an array pitch of 0.75 mm in the sliding direction and an array pitch of 0.75 mm in the direction orthogonal to the sliding direction. The area occupied by the recesses in the sliding member obtained at this time is approximately 25% of the area of the sliding surface.

Reference Example

A die with Ni electrocast cylinders is prepared. This die has a region (50 mm×400 mm) in which cylindrical projections with a diameter of 0.2 mm and a height of 0.1 mm form a staggered grid array pattern. The array pattern includes rectangular basic grids with an array pitch of 0.6 mm in the sliding direction and an array pitch of 0.4 mm in a direction orthogonal to the sliding direction. This die is fabricated by electro fine forming.

Further, a laminate sheet (80 mm×400 mm) is prepared. The laminate sheet is obtained by bonding together a polyimide resin sheet with a thickness of 75 μm that serves as a substrate, and a crosslinked PTFE sheet (Xeron XF-1B) with a thickness of 0.1 mm that serves as a fluororesin layer.

The die is laid over the fluororesin layer surface of the laminate sheet, and embossing is applied by applying pressure under heating at 180° C. with a pressing machine.

As a result, a sheet-like sliding member is obtained. The sheet-like sliding member has circular recesses with a diameter of 0.2 mm that form a staggered grid array pattern in the planar sliding surface of the fluororesin layer. The array pattern includes rectangular basic grids with an array pitch of 0.6 mm in the sliding direction and an array pitch of 0.4 mm in the direction orthogonal to the sliding direction.

The area occupied by the recesses in the sliding member obtained at this time is approximately 35% of the area of the sliding surface.

Evaluation

The sheet-like sliding member obtained in each of the above examples is attached to a belt/roller nip type fixing device in a high speed copier (Color 1000 Press manufactured by Fuji Xerox Co., Ltd.) (see FIG. 5; the inner surface of the heat belt 84 in which the sheet-like sliding member is placed has a surface roughness Ra of 0.6 μm). For the coefficient of friction between the member to be slid (the heat belt 84) and the sliding member, its initial value and its value after continuous operation with the process speed increased to 800 mm/sec are measured. The measured friction coefficients are evaluated. The results are illustrated as Table 1.

Evaluation Indices of Friction Coefficient

The criteria for evaluation of the friction coefficient of the sliding member are as follows.

A: The initial friction coefficient is not more than 1.0, and the friction coefficient after feeding 3,000,000 sheets (3 Mpv) is not more than 1.2.

B: The initial friction coefficient is not more than 1.0, and the friction coefficient after feeding 1,000,000 sheets (1 Mpv) is not more than 1.5.

C: The initial friction coefficient is not more than 1.0, and the friction coefficient after feeding 400,000 sheets (400 kpv) is not more than 1.5.

D: The initial friction coefficient is more than 1.0, and the friction coefficient after feeding 400,000 sheets (400 kpv) is more than 1.5.

TABLE 1

| | Ratio of area occupied by recesses to sliding surface | Initial friction coefficient | Evaluation of friction coefficient |
|---|---|---|---|
| Example 1 | 25% | 0.08 | A |
| Example 2 | 25% | 0.08 | A |
| Example 3 | 25% | 0.08 | A |
| Comparative Example 1 | 85% | 0.07 | C |
| Comparative Example 2 | 45% | 0.11 | D |
| Comparative Example 3 | 25% | 0.08 | D |
| Reference Example | 35% | 0.09 | B |

Also, the wear resistance of the sliding member is evaluated for Examples 1 to 3, Comparative Examples 1 and 2, and Reference Example.

Specifically, feeding of sheets is continued after the above-mentioned evaluation of friction coefficient, and the durability of the sliding member is evaluated.

Specifically, the amount of wear of the sliding member after feeding 500 k sheets at the time of the above-mentioned evaluation of friction coefficient is evaluated.

The results indicate the following. Examples 1 to 3 exhibit a small amount of wear ranging from 4 μm to 5 μm. In Comparative Example 1, the entire PTFE layer is worn out and the glass cloth is exposed. Comparative Example 2 exhibits a large amount of wear of 20 μm. Reference Example exhibits a relatively good value of 6 μm as the amount of wear.

From the results in Table 1 mentioned above, it is appreciated that each of the sheet-like sliding members according to Examples 1 to 3 has a low initial friction coefficient, and an increase in friction coefficient after feeding of a large number of sheets is minimized in comparison to Comparative Examples and Reference Example.

It is also appreciated that each of the sheet-like sliding members according to Examples 1 to 3 is subject to a reduced amount of wear in comparison to Comparative Examples.

As described above, each of the sheet-like sliding members according to Examples 1 to 3 keeps the coefficient of friction with the member to be slid from increasing even after prolonged, continued use, and also is subject to only a small amount of wear. Therefore, the life of the sliding member itself is extended, thereby achieving an increase in the life of the fixing image or image forming apparatus including this sliding member as a result.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sliding member for a fixing device, comprising at least a fluororesin layer that has a sliding surface, the sliding surface having a plurality of recesses that are dotted over the sliding surface, the sliding member satisfying conditions (1) and (2) below:

(1) the dotted recesses exhibit an array pattern including a grid array, the grid array having a plurality of basic arrays that are contiguous, the basic arrays each including a basic grid and a central point of the basic grid, the basic grid being defined by four grid points and having one side parallel to a sliding direction, at least one of the central points of the basic arrays in the grid array being displaced from the grid array; and (2) at least one recess exists on every straight line that defines a width of a central portion of the sliding surface along the sliding direction, wherein each of the basis arrays is configured such that no recesses other than recesses corresponding to the four grid points exist on a perimeter defined by the four grid points.

2. The sliding member for a fixing device according to claim 1, wherein in each of the basic grids of the array pattern, grid points of the four grid points lying along a direction orthogonal to the sliding direction are separated by a distance that is not more than approximately three times a diameter of the recesses.

3. The sliding member for a fixing device according to claim 2, wherein:

the dotted recesses have a period of not less than approximately 0.2 mm and not more than approximately 2.0 mm; and each one of the recesses has an area of not less than approximately $7\times10^{-3}$ $mm^2$ and not more than approximately 3.2 $mm^2$.

4. The sliding member for a fixing device according to claim 2, wherein in the sliding surface, the recesses occupy a total area of not less than approximately 10% and not more than approximately 60%.

5. The sliding member for a fixing device according to claim 1, wherein:

the dotted recesses have a period of not less than approximately 0.2 mm and not more than approximately 2.0 mm; and each one of the recesses has an area of not less than approximately $7\times10^{-3}$ $mm^2$ and not more than approximately 3.2 $mm^2$.

6. The sliding member for a fixing device according to claim 5, wherein in the sliding surface, the recesses occupy a total area of not less than approximately 10% and not more than approximately 60%.

7. The sliding member for a fixing device according to claim 1, wherein in the sliding surface, the recesses occupy a total area of not less than approximately 10% and not more than approximately 60%.

8. The fixing device comprising:

a first rotary body;

a second rotary body that is placed in contact with an outer surface of the first rotary body;

a pressing member that is placed inside the second rotary body, the pressing member pressing the second rotary body against the first rotary body from an inner surface of the second rotary body;

the sliding member lies between the inner surface of the second rotary body and the pressing member, the sliding member being the sliding member for the fixing device according to claim 1; and a heat source that heats at least one of the first rotary body and the second rotary body.

9. The fixing device according to claim 8, wherein the inner surface of the second rotary body has a surface roughness Ra of not less than approximately 0.1 μm and not more than approximately 2.0 μm.

10. An image forming apparatus comprising:

an image carrier;

a charging section that charges a surface of the image carrier;

a latent image forming section that forms a latent image on the surface of the image carrier that has been charged;

a developing section that develops the latent image with a toner to form a toner image;

a transfer section that transfers the toner image to a recording medium; and a fixing section that fixes the toner image to the recording medium, the fixing section being the fixing device according to claim 8.

11. The sliding member for a fixing device according to claim 1, wherein the at least one of the central points corresponds to a closest recess to a center of the basic grid.

12. The sliding member for a fixing device according to claim 1, wherein each of the basic arrays is configured such that no recesses other than recesses corresponding to the four grid points and the central point exist inside a perimeter defined by the four grid points.

13. A sliding member for a fixing device, the sliding member comprising:

a fluororesin layer comprising a sliding surface, wherein the sliding surface comprises a plurality of recesses arranged in a grid array, wherein the grid array comprises a plurality of basic arrays, wherein each of the basic arrays comprises:

a basic array perimeter defined by four of the recesses; and a fifth one of the recesses provided inside the basic array perimeter;

wherein one side of the basic array perimeter is parallel to a sliding direction, wherein the basic array is configured such that a center of the basic array perimeter is nonconcentric with any center of any recess, wherein at least one recess exists on every straight line that defines a width of a central portion of the sliding surface along the sliding direction, and wherein the basic array perimeter is configured such that no recesses other than the four of the recesses exist on the basic array perimeter.

14. The sliding member according to claim 13, wherein the fifth one of the recesses is a closest recess to the center of the basic array perimeter.

15. The sliding member according to claim 13, wherein the basic array perimeter is configured such that no recesses other than the four of the recesses and the fifth one of the recesses exist inside the basic array perimeter.

16. A sliding member for a fixing device, the sliding member comprising:

a fluororesin layer comprising a sliding surface, wherein the sliding surface comprises a plurality of recesses arranged in a grid array, wherein the grid array comprises a plurality of basic arrays, wherein each of the basic arrays comprises:

a basic array perimeter defined by four of the recesses; and a fifth one of the recesses provided inside the basic array perimeter;

wherein one side of the basic array perimeter is parallel to a sliding direction, wherein the basic array is configured such that a center of the basic array perimeter is nonconcentric with any center of any recess, wherein at least one recess exists on every straight line that defines a width of a central portion of the sliding surface along the sliding direction, and wherein the basic array perimeter is configured such that no recesses other than the four of the recesses and the fifth one of the recesses exist inside the basic array perimeter.

* * * * *